United States Patent [19]

Tucker et al.

[11] Patent Number: 4,762,645

[45] Date of Patent: Aug. 9, 1988

[54] DETERGENT PLUS SOFTENER WITH AMIDE INGREDIENT

[75] Inventors: James R. Tucker; Daniel F. Nesbitt, both of Cincinnati, Ohio

[73] Assignee: The Procter & Gamble Company, Cincinnati, Ohio

[21] Appl. No.: 121,315

[22] Filed: Nov. 16, 1987

[51] Int. Cl.[4] ..... C11D 3/30

[52] U.S. Cl. ..... 252/544; 252/8.6; 252/8.75; 252/8.8; 252/98; 252/102; 252/525; 252/541; 252/174; 252/174.25

[58] Field of Search ..... 252/8.6, 8.75, 8.8, 252/98, 102, 525, 541, 544, 174.25, 174

[56] References Cited

U.S. PATENT DOCUMENTS

| | | | |
|---|---|---|---|
| 3,555,056 | 1/1971 | Crercentini et al. | 8/495 |
| 3,594,447 | 7/1971 | Wincklhofer et al. | 524/226 |
| 3,936,537 | 2/1976 | Baskerville et al. | 427/242 |
| 3,965,015 | 6/1976 | Bauman | 252/102 |
| 4,141,841 | 2/1979 | McDonald | 252/8.8 |
| 4,294,710 | 10/1981 | Hardy et al. | 252/8.8 |
| 4,589,988 | 5/1986 | Rieck et al. | 252/8.8 |

FOREIGN PATENT DOCUMENTS

| | | |
|---|---|---|
| 6178086 | 8/1986 | Australia . |
| 3530302 | 8/1985 | Fed. Rep. of Germany . |

OTHER PUBLICATIONS

Pending U.S. patent application Ser. No. 922,912, Baker et al.

Pending U.S. patent application Ser. No. 102,183, Nesbitt et al.

Pending U.S. patent application Ser. No. 61,062, Caswell et al.

Pending U.S. patent application Ser. No. 61,061, Baker et al.

*Primary Examiner*—Paul Lieberman

*Assistant Examiner*—Hoa Van Le

*Attorney, Agent, or Firm*—Donald E. Hasse; Richard C. Witte; Thomas H. O'Flaherty

[57] ABSTRACT

Granular laundry detergent or detergent additive compositions containing a fabric care agent comprising 1,3 dialkyl (or dialkenyl) amidodiethylenetriamine (1,3 DDETA) providing softening and static control benefits.

13 Claims, No Drawings

DETERGENT PLUS SOFTENER WITH AMIDE INGREDIENT

TECHNICAL FIELD

This invention relates to a granular laundry detergent or detergent additive composition comprising a fabric care agent consisting of particles which provide antistatic and softening effects. The fabric care agent is comprised of from about 25% to 100% by weight of 1,3 dialkyl (or dialkenyl) amidodiethylenetriamine compound (hereinafter 1,3 DDETA) and from 0% to about 25% by weight of the corresponding imidazoline compound defined hereinafter, where the weight ratio of 1,3 DDETA to the imidazoline compound is at least about 3:1.

BACKGROUND OF THE INVENTION

In the laundry detergent field, numerous attempts have been made to formulate detergent compositions which provide the good cleaning performance expected of them and which also have good textile conditioning properties. Fabric conditioning agents found to provide antistatic and softening effects through the wash include quaternary ammonium compounds. Such compounds are preferably included in granular detergent compositions in a manner which minimizes their tendency to segregate out because of disparities in particle size. These quaternary ammonium compounds are preferably shielded in the wash water environment so that they are not inactivated by anionic surfactants commonly employed in laundering compositions. See U.S. Pat. Nos. 4,141,841, McDanald, issued Feb. 27, 1979, and 3,936,537, Baskerville, Jr. et al., issued Feb. 3, 1976.

Other antistatic/softening agents which also perform well in through-the-wash applications are imidazoline compounds of the formula:

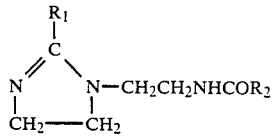

wherein $R_1$ and $R_2$ can independently be $C_{12}$ to $C_{20}$ hydrocarbyl groups. U.S. patent application Ser. No. 922,912, Baker et al., filed Oct. 24, 1986, discloses imidazoline compounds of a particle size between about 20 and about 200 microns which can be agglomerated, using any of a variety of binding agents known in the art, to form granular-sized (e.g., 1 millimeter) particles. Detergent compositions containing the agglomerates provide fabric care benefits as well as excellent cleaning performance.

U.S. patent application Ser. No. 102,183, Nesbitt et al., filed Sept. 29, 1987, describes an antistatic and softening particulate detergent additive comprised of the above imidazoline compound and nonaqueous agglomerating agent. Granular detergent compositions containing the additive are also described.

The above imidazoline compounds, unlike quaternary ammonium compounds, tend to hydrolyze during processing and storage. This hydrolysis opens the ringed imidazoline structure and forms the corresponding 1,3 dialkyl (or dialkenyl) amidodiethylenetriamine compound of the formula:

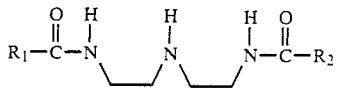

wherein $R_1$ and $R_2$ are independently $C_{12}$ to $C_{20}$ hydrocarbyl groups (1,3 DDETA).

Mixtures of greater than about 75% by weight of the imidazoline compound, with the remainder 1,3 DDETA, are very effective softeners and static control agents when incorporated into granular detergents. Mixtures of between about 25% and about 75% by weight of the imidazoline compound with the remainder 1,3 DDETA, are much less effective fabric care agents.

Surprisingly, it has now been found that 1,3 DDETA alone, and mixtures of greater than about 75% by weight 1,3 DDETA, with the remainder the imidazoline compound, are again effective at softening fabrics and controlling static cling when incorporated into granular detergent or detergent additive compositions as particles. For mixtures containing less than 75% 1,3 DDETA (e.g., as low as 25% by weight) and other ingredients such as other fabric care actives or protective coating, the weight ratio of 1,3 DDETA to imidazoline compound should be at least about 3:1, preferably at least about 4:1, more preferably at least about 6:1, for best performance.

Detergent and additive compositions containing these particles also have good dryer compatibility, i.e., no dryer paint softening or lint screen blinding is observed. 1,3 DDETA also has a stability advantage over the imidazoline compound in that the former will not have its efficacy as softener and antistat reduced by hydrolysis.

It is an object of the present invention to provide a granular detergent or detergent additive composition incorporating discrete fabric care particles which are directly added to, and homogeneously admixed in, the composition.

It is also an object of the present invention to provide a granular detergent or detergent additive composition incorporating discrete fabric care particles which soften fabrics and reduce the tendency of fabrics washed in the composition to generate or retain static electricity when subjected to a subsequent machine drying process.

It is another object of the present invention to provide a granular detergent composition incorporating discrete fabric care particles which is capable of concurrently laundering, softening, and imparting antistat benefits to fabrics washed therewith and subsequently machine dried.

BRIEF SUMMARY OF THE INVENTION

The present invention relates to a granular detergent or detergent additive composition comprising, by weight:

(a) from about 0% to about 95% of a surfactant selected from the group consisting of anionic surfactants, cationic surfactants, nonionic surfactants, zwitterionic surfactants, amphoteric surfactants, and mixtures thereof; and (b) from about 1% to about 95% of a fabric care agent consisting of particles comprising, by weight:

(i) from about 25% to 100% of a compound of the formula

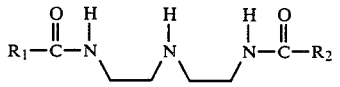

wherein $R_1$ and $R_2$ can independently be $C_{12}$ to $C_{20}$ hydrocarbyl groups; and (ii) from 0% to about 25% of imidazoline compound of the formula

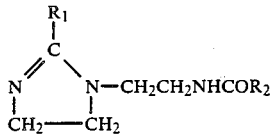

wherein $R_1$ and $R_2$ can independently be $C_{12}$ to $C_{20}$ hydrocarbyl groups; and the weight ratio of (i) to (ii) is at least about 3:1; and said particles having an average diameter of from about 20 to about 200 microns.

DETAILED DESCRIPTION OF THE INVENTION

The components of the present invention are described in detail below.

A. Fabric Care Agent

The fabric care agent of the present invention consists of particles comprising, by weight:

(a) from about 25% to 100% of a compound of the formula

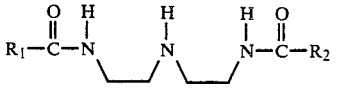

wherein $R_1$ and $R_2$ can independently be $C_{12}$ to $C_{20}$ hydrocarbyl (preferably alkyl or alkenyl, and more preferably $C_{16}$–$C_{18}$ alkyl or alkenyl) groups; and (b) from 0% to about 25% of the above corresponding imidazoline compound;

wherein the weight ratio of (i) to (ii) is at least about 3:1; and said particles having an average diameter of from about 20 to about 200 microns.

The compound (a) above is referred to as 1,3 dialkyl (or dialkenyl) amidodiethylenetriamine (1,3 DDETA). The tallowalkyl derivative thereof has also been referred to as N-N'-(iminodi-2,1-ethanediyl)bis-hydrogenated tallow amide. 1,3 DDETA may be formed by condensation of fatty acids with diethylenetriamine or by hydrolyzing the corresponding imidazoline compound of the formula

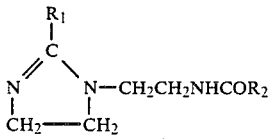

wherein $R_1$ and $R_2$ are as defined above, so that the ring structures open and 1,3 DDETA is formed. An intermediate which is also formed is 1,2 DDETA of the formula

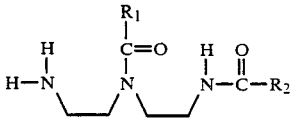

wherein $R_1$ and $R_2$ are as defined above. This intermediate may be present in amounts up to about 50% by weight of the fabric care particles. However, with time, it reverts to the corresponding 1,3 DDETA material. During the laundering operation, it is believed that substantially all of the 1,2 DDETA material has reverted or reverts to the 1,3 DDETA material.

The fabric care agent consists of particles, such as prills, with an average diameter of from about 20 to about 200 microns, preferably from about 50 to about 150 microns, and most preferably from about 60 to about 125 microns, in order to be most effective when incorporated into a granular detergent composition. A prill size less than 20 microns does not deposit properly on the fabric and prills greater than 200 microns may be visible as deposits on the dried fabric.

The term "average diameter" here refers to the mean particle size diameter. The mean is calculated on a weight percent basis by conventional analytical techniques such as, for example, laser light diffraction or microscopic determination. Preferably greater than 50% by weight, more preferably greater than 60% by weight, and most preferably greater than 70% by weight, of the particles have actual diameters which fall within the range of from about 20 to about 200 microns, preferably from about 50 to about 150 microns, and more preferably from about 60 to about 125 microns.

The fabric care agent is comprised of (by weight) from about 25% to 100% of 1,3 DDETA, preferably from about 50% to about 100%, most preferably from about 75% to about 95%, and from 0% to about 25% of the above described imidazoline compound, preferably from 0% to about 10%. Most preferably, the fabric care agent is substantially free of the imidazoline compound.

The fabric care agent particles preferably also comprise the dispersion inhibitor materials described in the above referenced Baskerville et al. and McDanald patents, which are incorporated herein by reference. The dispersion inhibitor preferably represents from about 1% to about 40%, more preferably from about 5% to about 20%, by weight of the particles. Particularly preferred are the $C_{12-20}$ fatty alcohols. The fatty alcohol is preferably comelted with the 1,3 DDETA compound before prilling. It is believed that the fatty alcohols improve fabric care performance by acting as a dispersion inhibitor as described in the Baskerville et al. and McDanald patents.

B. Granular Detergent Composition

The fabric care agent described above is incorporated in a finished granular detergent or detergent additive composition. Such compositions can contain from 0% to about 95% by weight of detergent surfactant, depending upon the particular intended use and the effects desired. Preferably, the detergent surfactants(s) represents from about 5% to about 60%, more preferably from about 10% to about 40%, by weight of the composition. The fabric care agent represents from about 1% to about 95%, preferably from about 3% to about 50%, more preferably from about 5% to about 25%, by weight of the composition.

The surfactant is selected from the group consisting of anionic, cationic, nonionic, amphoteric, and zwitterionic surfactants, and mixtures thereof. Examples of surfactants of these types are described in U.S. Pat. No. 3,579,454, Collier, issued May 18, 1971, incorporated herein by reference, from Column 11, line 45 through Column 13, line 64. An extensive discussion of surfactants is contained in U.S. Pat. No. 3,936,537, incorporated herein by reference, particularly Column 11, line 39 through Column 13, line 52. Anionic synthetic surfactants are particularly preferred for use herein.

Cationic surfactants can also be included in detergent compositions of the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Other optional ingredients which may be included in the detergent and detergent additive compositions herein include detergency builders, chelating agents, bleaching agents, antitarnish and anticorrosion agents, perfume and color additives, and other optional ingredients enumerated in the Baskerville patent, U.S. Pat. No. 3,936,537, from Column 19, line 53 through Column 21, line 21, incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference.

The detergent and detergent additive compositions of the instant invention preferably contain a detergency builder in an amount from about 5% to about 85% by weight, preferably from about 15% to about 60% by weight, and most preferably from about 20% to about 40% by weight of the entire detergent composition. Detergency builders are enumerated in the Baskerville patent from Column 13, line 54 through Column 16, line 16, and in U.S. Pat. No. 4,663,071, Bush et al., issued May 5, 1987, both incorporated herein by reference. Such builders include, for example, phosphates, aluminosilicates, silicates, carbonates, $C_{10}$–$C_{18}$ alkyl monocarboxylates, polycarboxylates, and polyphosphonates, and mixtures thereof.

The compositions of the present invention can optionally contain from about 1% to about 20%, and preferably from about 1% to about 10%, of percarboxylic acid bleaching agents, or bleaching compositions containing peroxygen bleaches capable of yielding hydrogen peroxide in an aqueous solution and bleach activators at specific molar ratios of hydrogen peroxide to bleach activator. These bleaching agents are fully described in U.S. Pat. No. 4,412,934, Chung et al., issued Nov. 1, 1983, and in U.S. Pat. No. 4,483,781, Hartman, issued Nov. 20, 1984, both of which are herein incorporated by reference. Such compositions provide effective and efficient surface bleaching of textiles which thereby remove stains and/or soils from the textiles.

The detergent and detergent additive compositions of the present invention optionally, but preferably, contain smectite clay as an ingredient. These smectite clays may be admixed with the composition at levels from about 1% to about 20% by weight, preferably about 5% to about 10% by weight. The clays used herein are "impalpable", i.e., have a particle size which cannot be perceived tactilely. Impalpable clays have particle sizes below about 50 microns; the clays used herein have a particle size range of from about 5 microns to about 50 microns.

The clay minerals can be described as expandable, three-layer clays, i.e., aluminosilicates and magnesium silicates, having an ion exchange capacity of at least 50 meq/100 g. of clay and preferably at least 60 meq/100 g. of clay. The term "expandable" as used to describe clays relates to the ability of the layered clay structure to be swollen, or expanded, on contact with water. The three-layer expandable clays used herein are those materials classified geologically as smectites.

There are two distinct classes of smectite clays that can be broadly differentiated on the basis of the numbers of octahedral metal-oxygen arrangements in the central layer for a given number of silicon-oxygen atoms in the outer layers.

The clays employed in the compositions of the instant invention contain cationic counterions such as protons, sodium ions, potassium ions, calcium ions, and lithium ions. It is customary to distinguish between clays on the basis of one cation predominantly or exclusively absorbed cation is predominantly sodium. Such absorbed cations can become involved in exchange reactions with cations present in aqueous solutions. A typical exchange reaction involving a smectite-type clay is expressed by the following equation: smectite clay $(Na)^+ + NH_4OH$ = smectite clay $(NH_4)^+ + NaOH$. Since in the foregoing equilibrium reaction, one equivalent weight of ammonium ion replaces an equivalent weight of sodium, it is customary to measure cation exchange capacity (sometimes termed "base exchange capacity") in terms of milliequivalents per 100 g. of clay (meq/100 g). The cation exchange capacity of clays can be measured in several ways, including by electrodialysis, by exchange with ammonium ion followed by titration, or by a methylene blue procedure, all as fully set forth in Grimshaw, "The Chemistry and Physics of Clays", pp. 264–265, Interscience (1971).

The cation exchange capacity of a clay mineral relates to such factors as the expandable properties of the clay, the charge of the clay (which in turn is determined at least in part by the lattice structure), and the like. The ion exchange capacity of clays varies widely in the range from about 2 meq/100 g. of kaolinites to about 150 meq/100 g., and greater, for certain smectite clays. Illite clays despite their three layer structure, are of a nonexpanding lattice type and have an ion exchange capacity somewhere in the lower portion of the range, i.e., around 26 meq/100 g. for an average illite clay. Attapulgites, another class of clay minerals, have a peculiar (i.e. needle-like) crystalline form with a low cation exchange capacity (25–30 meq/100 g.). Their structure is composed of chains of silica tetrahedrons linked together by octahedral groups of oxygens and hydroxyl containing Al and Mg atoms.

It has been determined that illite, attapulgite, and kaolinite clays, with their relatively low ion exchange capacities, are not useful in the instant compositions. Indeed, illite and kaolinite clays constitute a major component of clay soils and, as noted above, are removed from fabric surfaces by means of the instant compositions. However, the alkali metal montmorillonites, saponites, and hectorites, and certain alkaline earth metal varieties of these minerals such as calcium montmorillonites, have been found to show useful fabric-softening benefits when incorporated in compositions in accordance with the present invention. Specific examples of such fabric-softening smectite clay minerals are: sodium montmorillonite, sodium hectorite, sodium saponite, calcium montmorillonite, and lithium hectorite. Accordingly, smectite clays useful herein can be characterized as montmorillonite, hectorite, and saponite clay minerals having an ion exchange capacity of at least about 50 meq/100 g., and preferably at least 60 meq/100 g.

The above discussion of optional clay additives is intended to only be a cursory review of the subject matter contained in U.S. Pat. No. 3,936,537, Baskerville, Jr. et al., issued Feb. 3, 1976, incorporated herein by reference, particularly Column 16, line 18 through Column 19, line 51.

C. Method of Preparation

The fabric care agent can be prepared by allowing an imidazoline compound such as Varisoft 445 imidazoline from Sherex Chemical Company to hydrolyze to 1,3 DDETA. Molten hydrolyzed imidazoline compound is optionally mixed with molton $C_{12-20}$ fatty alcohol. The material is then formed into particles, or prills, with an average particle diameter between 20 and 200 microns. The desired particle sizes can be achieved by, for example, grinding solid material in blenders (e.g., an Oster® blender) or in large scale mills e.g., a Wiley® mill). A preferred method for forming the particles is to liquify the material and spray it via, for example, a single or two-fluid pressure nozzle to form droplets of the desired size range.

In another preferred method, a rotary disc can be used to form the droplets. The droplets are then solidified by cooling and may be screened to remove material which is too coarse. A tower-prilling technique can be used to obtain the same result, namely a mixture of substantially spherical droplets having a distribution of particle sizes about a given mean.

Another method of obtaining particulates of the desired size range is as follows. The molten imidazoline compound is solidified and then comminuted to obtain particles which are irregular and angular rather than uniform and spherical in shape. High energy comminution processes such as hammer, rod and ball mills, and air impact mills can be used, but preferably a low energy input process is employed which does not result in an appreciable temperature increase of the material being treated. While the theory of the process is not fully understood, it is believed that a low energy comminution process such as grating through a sieve avoids the surface softening or melting associated with processes involving higher energy inputs and thereby minimizes agglomeration of the comminuted material at this stage of the method of preparation. Any agglomerates which do form are fragile in nature and disintegrate under the subsequent agitated conditions of the wash into individual particles of the desired size range.

The fabric care particles can then be dedusted (optional) by spraying a small amount (usually less than 3%) of dedusting agent, such as $C_{12-13}$ alcohol, onto the prills. Optionally, the fabric care particles can be agglomerated by spraying a larger amount, generally about 5–20%, of the alcohol onto the prills.

Meanwhile, detergent base granules can be formed by mixing surfactants and optional ingredients such as builders, sulfate, and brightener in a crutcher, and spray drying in a drying tower. A nonionic surfactant can be sprayed onto the base granules.

The fabric care particles, detergent base granules, and optional ingredients such as clay, bleach and enzyme can be dry mixed. Perfume and nonionic surfactant can be sprayed onto this material.

The resulting detergent compositions provide the desired cleaning and fabric care benefits such as softness and static control.

Alternatively, the fabric care particles can be incorporated into a laundry detergent additive composition, which can comprise other ingredients such as surfactants, builders, bleaches, and other cleaning or fabric care additives.

Typical laundry wash water solutions comprise from about 0.1% to about 2% by weight of the detergent compositions of the invention. Fabrics to be laundered are agitated in these solutions to effect cleaning, stain removal, and fabric care benefits. The Ph of a 0.1% by weight aqueous solution of this composition will be in the range of from about 7.0 to about 11.0, preferably from about 8.0 to about 11.0, and most preferably from about 9.0 to about 10.5. It is possible for the detergent composition to be dispensed from a solid substrate in the wash.

The following nonlimiting examples illustrate the compositions of the present invention.

All parts, percentages and ratios herein are by weight unless otherwise specified.

EXAMPLES I–III

Granular laundry detergent compositons of the present invention are made as follows:

| Ingredient | Weight Percent | | |
|---|---|---|---|
| | I | II | III |
| Surfactants | | | |
| Sodium $C_{13}$ linear alkyl benzene sulfonate | 7.0 | 7.9 | 6.6 |
| Sodium $C_{14-15}$ alkyl sulfate | 7.0 | 7.9 | 6.6 |
| $C_{12-13}$ alcohol polyethoxylate 6.5 T* | 0.7 | 0.7 | 1.0 |
| Builders | | | |
| Sodium tripolyphosphate solids | 28.3 | 36.1 | 26.8 |
| Sodium silicate (1.6 r) | 5.6 | 5.6 | 4.2 |
| Sodium carbonate | 11.7 | 11.7 | 15.0 |
| Bleach | | | |
| Sodium perborate monohydrate | — | — | 5.0 |
| $C_9$ alkyloxybenzene sulfonate activator (solids) | — | — | 6.8 |
| Diethylenetriamine pentaacetic acid | — | — | 0.4 |
| Enzyme | | | |
| Savinase (Novo) | — | 0.7 | 0.6 |
| Fabric Care Agents | | | |
| 1,3 Ditallowamidodiethylenetriamine/tallow alcohol (80:20) | 7.2 | 7.2 | 7.2 |
| Sodium montmorillonite clay (solids) | 5.8 | 5.8 | 5.8 |
| Other Ingredients | | | |
| $C_{12-13}$ alcohol (dedusting agent) | 0.4 | 0.4 | 0.4 |
| Sodium sulfate | 19.8 | 9.6 | — |
| Polyethylene glycol (M. Wt. 8000) | — | — | 1.2 |
| Sodium polyacrylate (M. Wt. 4500) | — | — | 0.6 |
| Water and miscellaneous (including brightener, speckles | balance to 100 | | |

-continued

| Ingredient | Weight Percent I | II | III |
|---|---|---|---|
| colorant, suds suppressor and perfume) | | | |

*Alcohol and monoethoxylated alcohol removed.

The first step in the preparation of the detergent composition is the formation of detergent base granules. The surfactants, builders, sulfate, and brightener are added to a crutcher, mixed and spray dried in a drying tower. Prior to collection, $C_{12-13}$ alcohol polyethoxylate 6.5T is sprayed onto the detergent base granules.

Secondly, $C_{12-13}$ alcohol is sprayed onto the 1,3 ditallowamidodiethylenetriamine/tallow alcohol prills in a mixing drum. The 1,3 DDETA/TA prills, obtained from Sherex Chemical Corporation, are formed by allowing Varisoft® 445 imidazoline to hydrolyze and then comelting with molten tallow alcohol in about an 80:20 weight ratio (1,3 DDETA:tallow alcohol). The average particle diameter of the prills ranges from about 80 to about 100 microns (as determined by, for example, a Malvern® 2600 particle analyzer), and 80% by weight of the particles fall within the range of about 20 to about 200 microns. After dedusting, the prills are removed from the mixing drum and stored. Nuclear Magnetic Resonance (NMR) analysis (on a Varian XL-300) of a prill sample shows the following:

| Compound | Weight Percent |
|---|---|
| 1,3 DDETA | 78 |
| 1,2 DDETA | 3 |
| Fatty alcohol | 18 |
| Minors & Miscellaneous | 1 |

Thirdly, the detergent base granules, carbonate, sodium montmorillonite clay, and speckles colorant are put into the mixing drum and dry mixed. Bleaches, bleach activator, enzyme and suds suppressor, if any, are also added at this stage. After mixing, both perfume and $C_{12-13}$ alcohol polyethoxylate 6.5T are sprayed onto the materials.

In the final step, the 1,3 DDETA/TA prills are added to the mixing drum containing the detergent base granules, carbonate, clay, and speckles colorant. These components are mixed and then collected.

. The resulting detergent composition exhibits the desired cleaning and fabric care benefits such as softness and static control.

Other compositions of the present invention are obtained when the tallow alcohol is replaced with coconut alcohol, palmitic alcohol, or alcohols derived from saturated vegetable oils, and when the fatty alcohol comprises 15%, 5%, or 2% of the fabric care active particle.

Other compositions herein are also obtained when the fabric care active particles and/or the detergent base granules are not dedusted, or, in the alternative, are dedusted with other dedusting agents, such as polyethylene glycol or $C_{9-20}$ alcohol polyethoxylate.

Compositions herein are also obtained when the mixed surfactant system is replaced, in whole or in part, with other anionic and/or nonionic surfactants, including, but not limited to, $C_{8-18}$ alkylbenzene sulfonates, $C_{8-18}$ alkyl sulfate, $C_{10-22}$ alkyl ethoxy sulfates, $C_{12-18}$ alcohol polyethoxylates, amine oxides, and mixtures thereof.

EXAMPLES IV–V

Granular laundry detergent compositions of the present invention are made as described above in Examples I–III except that the fabric care agent does not include fatty alcohol, and is analyzed as 90% 1,3 DDETA and 4% of the corresponding imidazoline compound, with the balance being minors and miscellaneous.

Other compositions herein are obtained when the fabric care agent is analyzed to be 100% 1,3 DDETA; 90% 1,3 DDETA and 10% 1,2 DDETA; 85% 1,3 DDETA and 15% of the corresponding imidazoline compound; 98% 1,3 DDETA and 2% of the imidazoline compound; or 88% 1,3 DDETA, 6% 1,2 DDETA, and 6% of the imidazoline compound.

All of these detergent compositions provide cleaning as well as static control and softening benefits.

EXAMPLES VI–IX

Granular laundry detergent compositions of the present invention are made as described above in Examples I–III.

| Ingredient | Weight Percent VI | VII | VIII | IX |
|---|---|---|---|---|
| Surfactants | | | | |
| Sodium $C_{13}$ linear alkyl benzene sulfonate | 7.1 | 20.1 | 9.4 | — |
| Sodium $C_{12}$ alkyl benzene sulfonate | — | — | — | 17.6 |
| Sodium $C_{14-15}$ alkyl sulfate | 7.1 | — | 9.4 | — |
| $C_{12-13}$ alcohol polyethoxylate 6.5 T* | 1.1 | — | 0.9 | — |
| Builders | | | | |
| Sodium tripolyphosphate solids | 28.9 | 36.9 | — | 24.8 |
| Sodium silicate (1.6 r) | 11.0 | 5.7 | 1.7 | 6.8 |
| Aluminosilicate | — | — | 23.0 | — |
| Sodium carbonate | 16.0 | — | 4.7 | |
| Bleach | | | | |
| Sodium perborate monohydrate | 4.9 | — | — | — |
| $C_9$ alkyloxybenzene sulfonate activator | 6.8 | — | — | — |
| Diethylenetriamine pentaacetic acid | 1.2 | — | — | — |
| Enzyme | | | | |
| Savinase (Novo) | 0.6 | — | — | — |
| Fabric Care Agents | | | | |
| 1,3 Ditallowamidodiethylenetriamine | 6.9 | 8.9 | 5.8 | 1.5 |
| Sodium montmorillonite clay (solids) | — | — | — | 9.8 |
| Other Ingredients | | | | |
| Sodium sulfate | — | 28.3 | 33.3 | 37.3 |
| Water and miscellaneous | | balance to 100 | | |

*Alcohol and monoethoxylated alcohol removed.

What is claimed is:

1. A granular detergent or detergent additive composition comprising, by weight:

(a) from about 0% to about 95% of a surfactant selected from the group consisting of anionic surfactants, cationic surfactants, nonionic surfactants, zwitterionic surfactants, amphoteric surfactants, and mixtures thereof; and (b) from about 1% to about 95% of a fabric care agent consisting of particles comprising, by weight:

(i) from about 25% to 100% of a compound of the formula

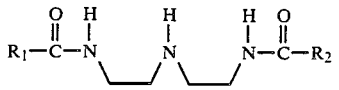

wherein $R_1$ and $R_2$ can independently be $C_{12}$ to $C_{20}$ hydrocarbyl groups; and (ii) from 0% to about 25% of imidazoline compound of the formula

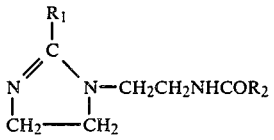

wherein $R_1$ and $R_2$ can independently be $C_{12}$ to $C_{20}$ hydrocarbyl groups; and the weight ratio of (i) to (ii) is at least about 3:1; and said particles having an average diameter of from about 20 to about 200 microns.

2. A composition according to claim 1 wherein the fabric care agent has an average particle diameter of from about 50 to about 150 microns.

3. A composition according to claim 2 wherein the fabric care agent further comprises from about 1% to about 40% of $C_{12-20}$ fatty alcohol.

4. A composition according to claim 3 wherein the fabric care agent comprises from about 5% to about 20% of $C_{12-20}$ fatty alcohol.

5. A composition according to claim 4 wherein the fabric care agent comprises from about 75% to about 95% of the compound of the formula

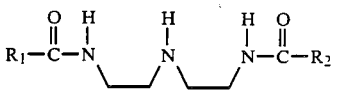

wherein $R_1$ and $R_2$ are $C_{16}$-$C_{18}$ alkyl or alkenyl groups, and is substantially free of the imidazoline compound.

6. A composition according to claim 5 wherein the fabric care agent has an average particle diameter of from about 60 to about 125 microns.

7. A granular detergent composition according to claim 1 comprising from about 5% to about 60%, by weight of the composition, of surfactant and from about 3% to about 50%, by weight of the composition, of fabric care agent.

8. A granular detergent composition according to claim 7 which additionally comprises from about 5% to about 85% of a detergent builder.

9. A granular detergent composition according to claim 8 which additionally comprises from about 1% to about 20% of clay.

10. A granular detergent composition according to claim 9 which additionally comprises from about 1% to about 20% of a bleaching compound.

11. A granular detergent composition according to claim 9 wherein the fabric care agent comprises from about 75% to about 95% of the compound of the formula

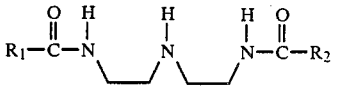

wherein $R_1$ and $R_2$ are $C_{16}$-$C_{18}$ alkyl or alkenyl groups, and is substantially free of the imidazoline compound.

12. A granular detergent composition according to claim 11 wherein the fabric care agent further comprises from about 5% to about 20% of $C_{12-20}$ alcohol.

13. A granular detergent composition according to claim 12 wherein the fabric care agent has an average particle diameter of from about 60 to about 125 microns.

* * * * *

UNITED STATES PATENT AND TRADEMARK OFFICE

CERTIFICATE OF CORRECTION

PATENT NO. : 4,762,645

DATED : Aug. 9, 1988

INVENTOR(S) : JAMES R. TUCKER & DANIEL F. NESBITT

It is certified that error appears in the above-identified patent and that said Letters Patent are hereby corrected as shown below:

Column 6, line 33, after the first "absorbed", insert -- . For example, a sodium clay is one in which the absorbed --.

Column 7, line 31, "molton" should be -- molten --.

Signed and Sealed this

Seventeenth Day of January, 1989

*Attest:*

DONALD J. QUIGG

*Attesting Officer*

*Commissioner of Patents and Trademarks*